US005378070A

United States Patent [19]

Lyga

[11] Patent Number: 5,378,070

[45] Date of Patent: Jan. 3, 1995

[54] TAPE POSITIONING APPARATUS FOR MAILING MACHINE

[75] Inventor: Thomas M. Lyga, Torrington, Conn.

[73] Assignee: Pitney Bowes Inc., Stamford, Conn.

[21] Appl. No.: 14,600

[22] Filed: Feb. 8, 1993

[51] Int. Cl.[6] ..... B41J 15/18

[52] U.S. Cl. ..... 400/615.2; 101/91

[58] Field of Search ..... 400/605, 607, 615.2, 400/621, 642; 101/91

[56] References Cited

U.S. PATENT DOCUMENTS 4,922,085 5/1990 Dannatt ..... 101/92

4,929,106 5/1990 Buan et al. ..... 400/649

*Primary Examiner*—David A. Wiecking

*Assistant Examiner*—Steven S. Kelley

*Attorney, Agent, or Firm*—Melvin J. Scolnick; David E. Pitchenik; Steven J. Shapiro

[57] ABSTRACT

A tape positioning apparatus is disclosed which is used in a mailing machine having means for printing a postage indicia on a discrete portion of a strip of tape of indefinite length which is fed intermittently through the mailing machine. The apparatus includes a tape feed chute which moves the tape from a normal position out of alignment with the printing die of a postage meter in the mailing machine to a printing position in which the tape is aligned with the printing die. In order to assure proper feeding of the tape from the chute to a cutting device, the apparatus is provided with a latching device for latching the free end of the chute in a home position so that the leading edge of the tape cannot snag on any portion of the tape path as it is pushed from the chute to the cutting device after printing has taken place.

9 Claims, 3 Drawing Sheets

TAPE POSITIONING APPARATUS FOR MAILING MACHINE

The following U.S. Patent discloses a tape positioning apparatus related to the present invention: U.S. Pat. No. 4,922,085 for MAILING MACHINE TAPE MODULE AND TAPE DRIVE THEREOF, assigned to the assignee of this application.

The following U.S. Patent discloses a platen drive assembly related to the present invention: No. 4,929,106 for PLATEN MODULE, assigned to the assignee of this application.

BACKGROUND OF THE INVENTION

The present invention relates generally to an apparatus for positioning tape to and from a printing apparatus, and more particularly to a tape positioning apparatus for use in a mailing machine in which tape is selectively moved to and from a printing position in which postage indicia is printed on the tape when the mailing machine is not printing the postage indicia on discrete envelopes. Modern day mailing machines, such as that shown and described in the aforementioned U.S. Pat. No. 4,922,085, have evolved into highly sophisticated, multi-functional machines capable of processing a plurality of mail pieces of different types through the steps required to affix proper postage to them for handling by the U.S. Postal Service. For example, the mailing machine just mentioned can store a plurality of mail pieces in a hopper, successively feed them seriatim to a weighing module which electronically determines the amount or postage required for each mail piece, print that amount of postage as an indicia either directly on the mail piece if it is relatively thin, such as a typical letter envelope or on a strip of tape which is applied to the envelope if it is too thick to feed through the printing mechanism, and finally deposit mail pieces in an orderly fashion in any of a variety of stacking devices for retrieval and further handling by Postal Service representatives. It should also be noted that the foregoing process occurs at a high rate of speed, usually in the order of 2 per second if weighing each piece is involved, 4 per second if weighing is not involved. Thus, it will be apparent that to accomplish this process at the indicated speed, the mailing machine requires a great number of mechanical parts which must fit together accurately and operate smoothly, and a highly complex electronic control system including various operator controlled devices and modules for setting up and operating the mailing machine, microprocessors for controlling the synchronous operation of various components and devices, and diagnostic systems for detecting various malfunctions and providing appropriate indication thereof.

In the mailing machine under consideration, a strip of tape of indefinite length is stored in a tape storage apparatus which is located adjacent the envelope output end of the mailing machine, in a position laterally offset from the longitudinal path of envelopes as they are fed through the mailing machine. The reason for this is that the mailing machine incorporates a postage meter module which has a flat bed type of printing device for applying postage indicia either to the envelopes as they are fed through the mailing machine or to a discrete portion of the strip of tape, depending on whether the mailing machine is in an envelope printing mode or a tape printing mode, the modes being under the control of an operator of the mailing machine. In the former mode, as envelopes are fed through the mailing machine by suitable feeding devices, an appropriate postage indicia is printed on the envelope in the proper location by the printing device which includes a movable element for raising the envelope to bring it into contact with a fixed printing die. In the latter mode, a mechanism must be provided for performing the same operation on the strip of tape to bring a discrete portion thereof into contact with the stationary printing die.

It is apparent, therefore, that the mailing machine has but one printing position, which is defined by the location of the printing die within the postage meter module of the mailing machine. Since far more regular envelope mail is processed through the mailing machine than oversized or over thick envelopes which cannot be processed through the normal envelope printing operation, the postage meter module is positioned in the mailing machine such that the postage indicia printing die is disposed in lateral alignment with the longitudinal path of the portion of the envelopes on which the postage indicia is printed. Thus, in order to print postage indicia on the strip of tape, it must be moved from the aforementioned offset position to a position in which the tape is laterally aligned with the printing die. The present invention hereinafter described and illustrated is directed to the apparatus for moving the tape back and forth between the offset position and the aligned position.

One of the requirements of the mailing machine under consideration is that of providing a tape positioning apparatus which can shuttle the tape between the aforementioned positions at a high rate of speed and with precise accuracy in the respective positions. Since the mailing machine operates at a high rate of speed in terms of the number of mail pieces processed as mentioned above, it is necessary that the tape positioning apparatus move between the offset and aligned positions not only with great speed but with very precise accuracy so that the tape is fed through the mailing machine smoothly and without interruption. The principal problem that occurs in alternate tape positioning as in the mailing machine under consideration is that of ensuring that the tape will feed smoothly and without jamming consistently and at a high rate of speed. After the postage indicia is printed on the strip of tape, the strip is fed in a forward direction to bring the trailing edge of the printed portion of the strip into alignment with a cutting device which severs the printed portion of the tape from the rest of the strip. Thereafter, the severed portion is fed through a delivery mechanism to a suitable location for retrieval by the operator of the mailing machine, while at the same time the strip of tape is fed in a reverse direction to bring the discrete portion of the tape on which printing will take place into the proper position for the next printing cycle on the tape.

Within the printing area of the mailing machine, the portion of the tape on which printing takes place is held in an elongate chute which shuttles that portion of the tape back and forth between the aforementioned offset and aligned positions. It was found, during the early stages of the design and development of the present invention, that the chute carrying the tape would not always return to the precise offset position from which it started at the beginning of a printing cycle, with the result that the leading edge of the strip of tape would not move smoothly from the outlet end of the chute past the cutting device and into the inlet end of the delivery mechanism. The downstream end of the chute would stop in a position in which it was slightly misaligned with the upstream end of the delivery mechanism, as a result of which the leading edge of the tape would snag on some portion of the structure defining the inlet end of the delivery mechanism and would jam in this position. Each time a jam occurred, the jam sensing mechanism would stop the mailing machine until the jam was cleared, which required that certain portions of the mailing machine not normally accessible to an operator had to be opened to permit an operator to clear the jam, thereby causing considerable down time. It is quite obvious that such a condition would be completely unacceptable in a high speed mailing machine.

In the course of further design and development of the present invention, other different design approaches were considered for an apparatus which would provide the necessary feeding characteristics of the tape. One in particular, which was a magnet mounted on the frame of the mailing machine to hold the downstream end of the chute in place, provided some degree of success at solving the foregoing problem, but not with the degree of accuracy required to provide the consistently smooth operation of the tape that was deemed necessary. It was not until the advent of the present invention that the feeding problem was considered satisfactorily solved in terms of providing a viable product.

BRIEF DESCRIPTION OF THE INVENTION

In its broader aspects, the present invention is a tape positioning apparatus for use in a mailing machine having means for printing a postage indicia on a discrete portion of a strip of tape of indefinite length which is fed through the mailing machine. The apparatus comprises a printing device mounted in the mailing machine which defines a printing position, the printing device including means for printing a postage indicia on a strip of tape as it is fed intermittently through the mailing machine. An elongate chute has wall means which define a first tape channel extending through the chute and having inlet and outlet ends through which the strip of tape is adapted to be fed. A tape guide means is disposed adjacent the outlet end of the first tape channel and defines a second tape channel extending therethrough which has in inlet end normally disposed adjacent the outlet end of the first tape channel and an outlet end spaced from the inlet end. A tape cutting means is disposed adjacent the outlet end of the second tape channel for cutting the tape after the printed portion thereof passes the outlet end of the second tape channel. The apparatus includes means mounted in the mailing machine for supporting the chute for reciprocatory movement between a home position in which the chute is disposed remote from the printing position and in which the first and second tape channels are in longitudinal alignment, and the printing position in which the tape therein is in operative relationship with the printing device and the first and second tape channels are disposed out of longitudinal alignment. Finally, there is means mounted adjacent the outlet end of the first tape channel for latching the chute adjacent the outlet end of the first tape channel when the chute is in the home position so that the outlet end of the first tape channel is in precise alignment with the inlet end of the inlet end of the second tape channel, so that the leading edge of the unsevered strip of tape passes smoothly from the chute to the cutting means after each successive printing operation.

In some of its more limited aspects, the tape cutting means is mounted for reciprocatory movement across the path of movement of the tape adjacent the outlet end of the second tape channel, and the latching means includes means responsive to the reciprocatory movement of the cutting means for latching and unlatching the outlet end of the chute. This means includes an abutment member on the cutting means and means on the latching means mounted in the path of movement of the abutment means for causing the latching means to latch and unlatch the outlet end of the chute as the cutting means moves across the path of movement of the tape.

In further limited aspects, the latching means comprises a latching bar mounted for movement between a latching position and an unlatching position, the bar being mounted at one end for pivotal movement and having a latching finger at the other end which projects at an angle to the longitudinal axis of the latching bar so as to abut a side wall of the chute when the latching bar is in its latching position.

Having briefly described the general nature of the present invention, it is a principle object thereof to provide a tape positioning apparatus for a mailing machine which rapidly and effectively moves a strip of tape to and from a printing position for printing of postage indicia thereon when called for by the mailing machine.

Another object of the present invention is to provide a tape positioning apparatus for a mailing machine which moves a strip of tape to and from a printing position and accurately aligns the outlet end of a movable chute having a tape channel therein with the inlet end of a stationary tape channel leading to a cutting device.

Still another object of the present invention is to provide a tape positioning apparatus for a mailing machine in which a latching mechanism for the movable chute is actuated for movement between a latching position and an unlatching position in response to movement of a cutting device which moves across the path of movement of the tape in timed synchronism with the tape feeding and printing operations of the mailing machine.

These and other objects and advantages of the present invention will become more apparent from an understanding of the following detailed description of a presently preferred embodiment of the invention, when considered in conjunction with the accompanying drawings.

DETAILED DESCRIPTION OF THE PREFERRED EMBODIMENT

Figure 1:
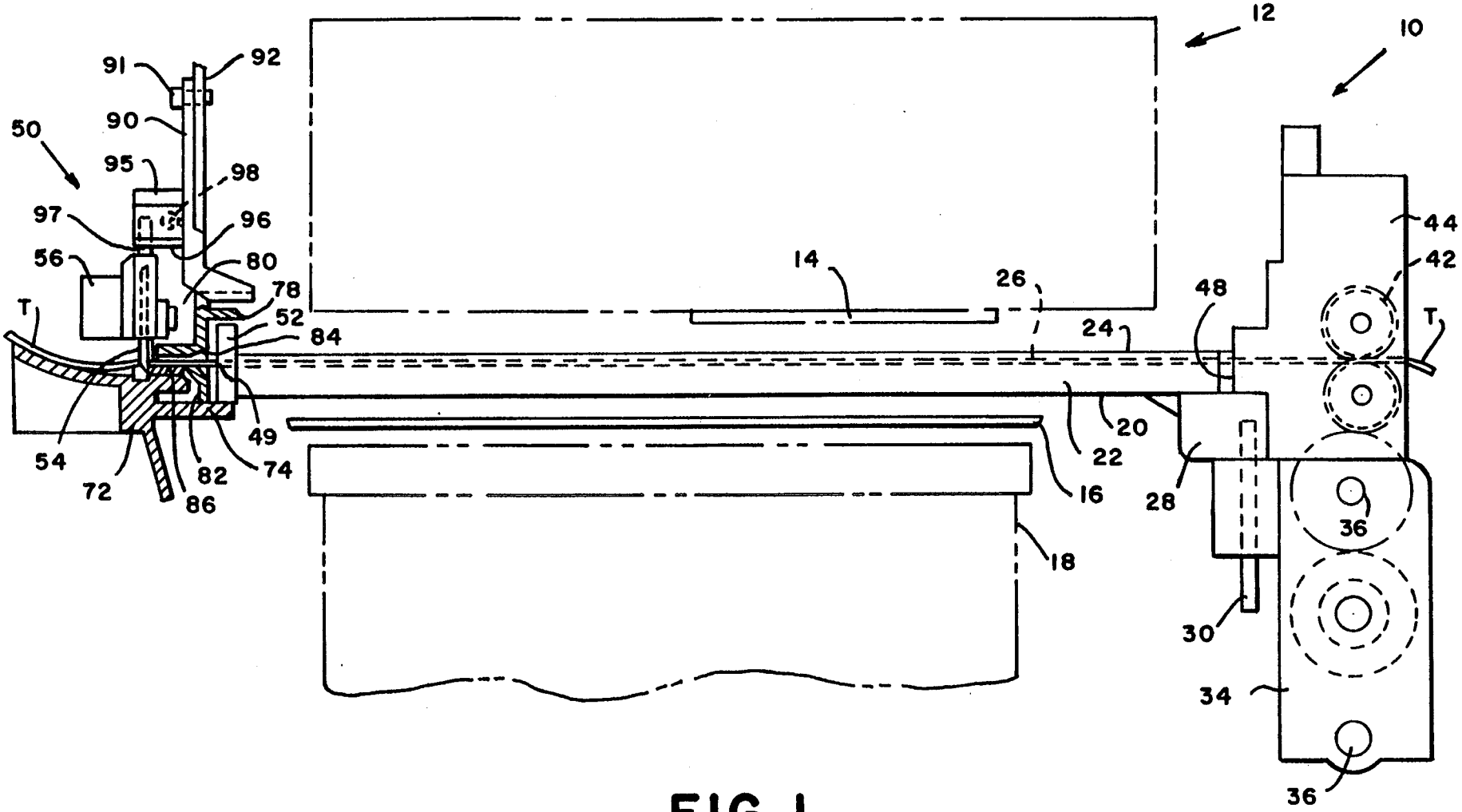
FIG. 1 is a front view of the postage meter module of the mailing machine which incorporates the present invention, showing the tape positioning apparatus in its home or static position.
Figure 2:
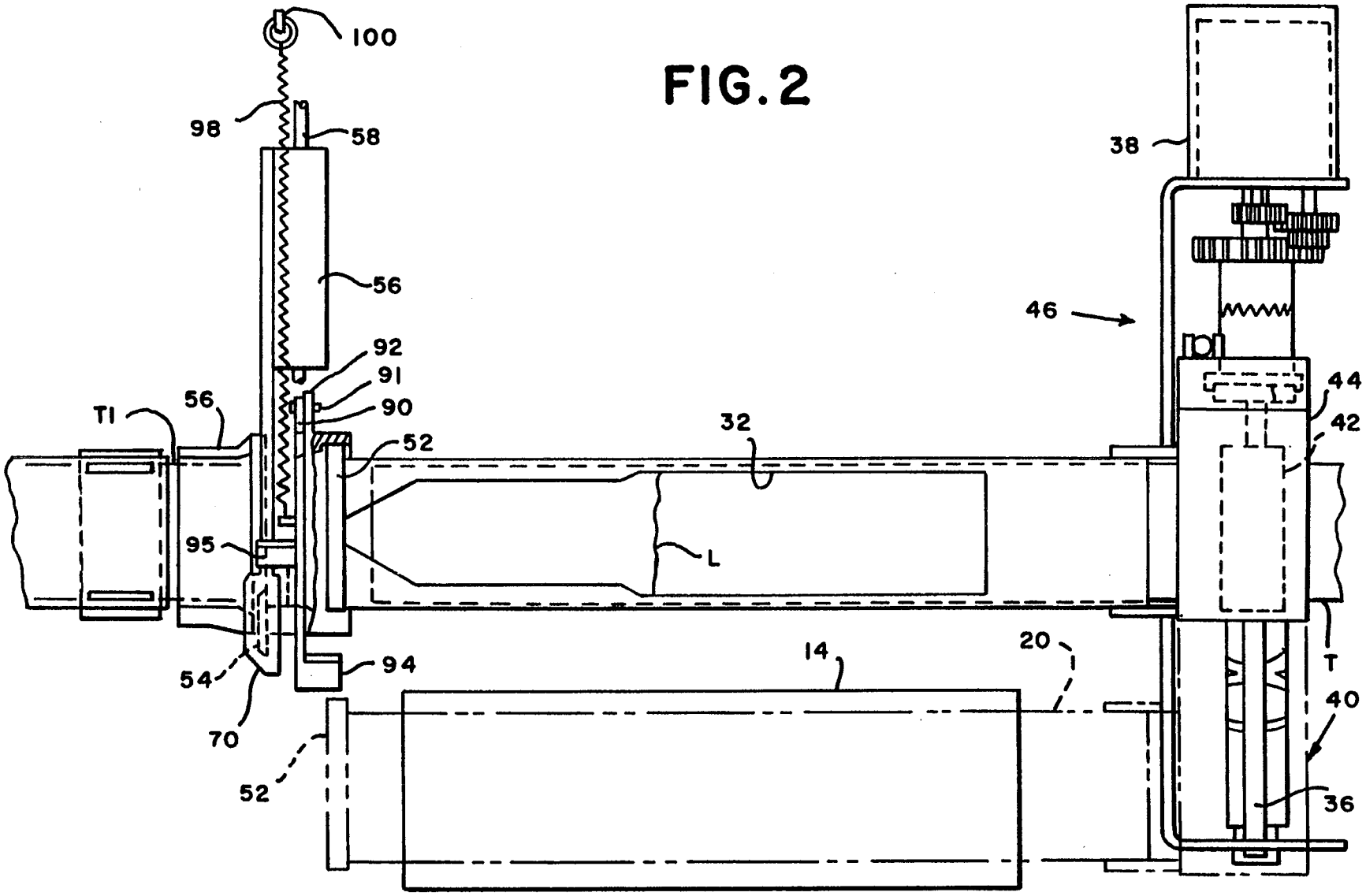
FIG. 2 is a plan view similar to FIG. 1 but with the postage meter module removed to reveal essential detail of the present invention.

Referring now to the drawings and particularly to FIGS. 1 and 2 thereof, the reference numeral 10 designates generally a mailing machine through which letter mail is fed for printing of appropriate postage indicia thereon. In the type of mailing machine in which the present invention is utilized, as shown in the above identified patent, letter mail is stacked in the hopper of a suitable feeder and is fed seriatim along a feed path by suitable feeding devices. The mail pieces are fed onto the platform of a weighing scale which weighs each piece and determines the amount of postage required, whereupon, by suitable electronic and mechanical components, the postage meter is automatically set to print a postage indicia indicating that amount of postage, along with other information. When the meter is set, a lifting mechanism, including a platen which fits into a recess in the scale platform, raises the envelope to bring it into contact with the underside of a printing die located in the postage meter module so that an ink impression of the printing die is deposited on the mail piece, after which it is lowered to its original position and fed out of the mailing machine and onto a suitable stacking apparatus attached to the output end of the mailing machine. A more detailed description of the scale, platform and postage meter printing device can be found in the aforementioned U.S. Pat. No. 4,929,106

As briefly mentioned above, in the case of mail pieces which are too thick to be fed through the mailing machine, the amount of postage required is determined by weighing these mail pieces on a separate scale from which the proper amount of postage is automatically entered into the postage meter, which includes suitable controls for causing that amount of postage to be printed on a strip of gummed or sticky-back tape which is manually applied to the mail piece after it exits from the mailing machine. As also briefly mentioned earlier, since the postage meter utilized in the mailing machine under consideration is of the flat bed type, that is, it has a stationary flat printing die against which the object to be printed upon is pressed, there is only one printing position, which is the location of the die. Therefore, if printing is to take place on a strip of tape which is normally located away from the printing position of the postage die, the strip must be moved into the printing position when it is desired to have the postage printed on the strip for application to an oversized mail piece. However, after the postage indicia is printed on the tape, the portion thereof bearing the postage indicia must be severed from the strip and transported to a location from which it can be manually retrieved. To accomplish this, the device carrying the tape from the home position to the printing position and back must return to precisely the same home position during each cycle of operation. The manner in which this is accomplished is the subject matter of the present invention. Therefore, details of the mailing machine, the postage meter module and other components of the mailing machine which do not form essential parts of the present invention are not further described, except as specifically noted above.

Referring again to FIGS. 1 and 2, the reference numeral 12 indicates generally the postage meter module of the mailing machine 10 and includes a printing device having a printing die 14 suitably held on the underside of the postage meter 12 and which contains the postage indicia which is to be printed on mail pieces or on tape. A platform 16 extends longitudinally of the mailing machine 10 and defines a feed path for mail pieces capable of being fed through the mailing machine 10 for postage processing. The platform 16 is part of a weighing scale, which is not further disclosed, located in that portion of the mailing machine 10 which includes the postage meter 12 and which performs the aforementioned weighing function on the mail pieces. A platen 18 is normally disposed below the level of the scale platform 16 and rises through a suitable cutout in the platform 16 to press mail pieces against the underside of the printing die 14 to print the postage indicia on the mail pieces as explained above, in a manner more fully disclosed in the aforementioned U.S. Pat. No. 4,929,106. It will be seen from FIG. 3 that the platform 16 and platen 18 are in a relatively forward location in the mailing machine 10 with respect to that part of the mailing machine which faces the operator and, although not shown in FIG. 3 so as not to obscure details of the present invention, the printing die 14 of the postage meter 12 is in this same relative forward location.

In order to avoid interference between the tape feeding mechanism and the mail piece printing mechanism just described, it is necessary to normally maintain the tape feeding mechanism in a location which is behind the normal mail piece feed path as defined by the platform 16 and the printing die 14. Thus, the tape is guided through the postage meter module of the mailing machine by an elongate, generally rectangular chute 20 which includes a relatively thick and stable base 22 and a thin upper wall 24 which cooperates with the base 22 to define a relatively thin first tape channel 26 having inlet and outlet ends and through which tape T is fed. The chute 20 is suitably connected at one end to a support member 28 which is mounted for vertical movement along a shaft 30 which permits the chute 20 to move up and down in response to movement of the platen 18. The upper wall 24 of the chute is provided with a suitably shaped aperture 32 which exposes the upper surface of the tape and through which the tape T is pressed against the under surface of the printing die 14 in order to print the postage indicia on the tape.

The support member 28 to which the chute 20 is connected is itself connected to housing 34 which is mounted on a pair of rails 36 for reciprocatory movement in a forward and backward direction relative to the forward portion of the mailing machine. The forward and backward movement of the chute 20 is controlled by a motor 38 and a drive assembly generally designated by the numeral 40, the details of which are not further described since they form no part of the present invention, except as specifically noted below. A more complete description of the drive assembly may be found in the aforementioned U.S. Pat. No. 4,922,085. The essential function of this drive assembly is to move the chute 20 from its home position shown in solid lines in FIG. 2 in which the chute 20 is aligned at both ends with the normal straight tape feed path through the mailing machine, to the printing position shown in dotted lines in FIG. 2 in which the chute 20 is disposed directly beneath the printing die 14 of the postage meter.

A pair of feed rollers 42 are mounted in another housing 44 suitably connected to the support member 28 and the chute 20 so as to feed the tape T through the chute in response to appropriate commands from a central control system which controls and coordinates all of the functions of the mailing machine. The feed rollers 42 are driven by a drive assembly generally designated by the numeral 46, again which is not further described since this drive assembly forms no part of the present invention. The feed rollers 42 push the tape T into an inlet end 48 of the first tape channel 26 and then through the channel to the outlet end 49 thereof when the central control system calls for additional tape in the manner described below in connection with the description of the operation of the invention.

A tape cutting mechanism, generally designated by the reference numeral 50, is suitably connected to the mailing machine adjacent the free end 52 of the chute 20 and operates to sever a printed portion of the tape T' from the strip for manual retrieval by the operator of the mailing machine in a manner more fully described below. Thus, a cutting wheel 54 is suitably mounted on a cutter arm 56 which is mounted for linear reciprocatory movement on a pair of rails 58 (FIG. 3) suitably connected into the mailing machine. The cutter arm 56 includes a downwardly extending arm 60 which has a vertical slot 62 in which an eccentric wheel 64 rides, the eccentric wheel being mounted on a large wheel 66 or crank arm suitably connected as by the shaft 68 to a motor for rotation of the wheel or crank arm 66. It will be apparent that as the wheel or crank arm 66 rotates, the eccentric wheel 64 causes the cutter arm 56 to reciprocate laterally.

Figure 3:
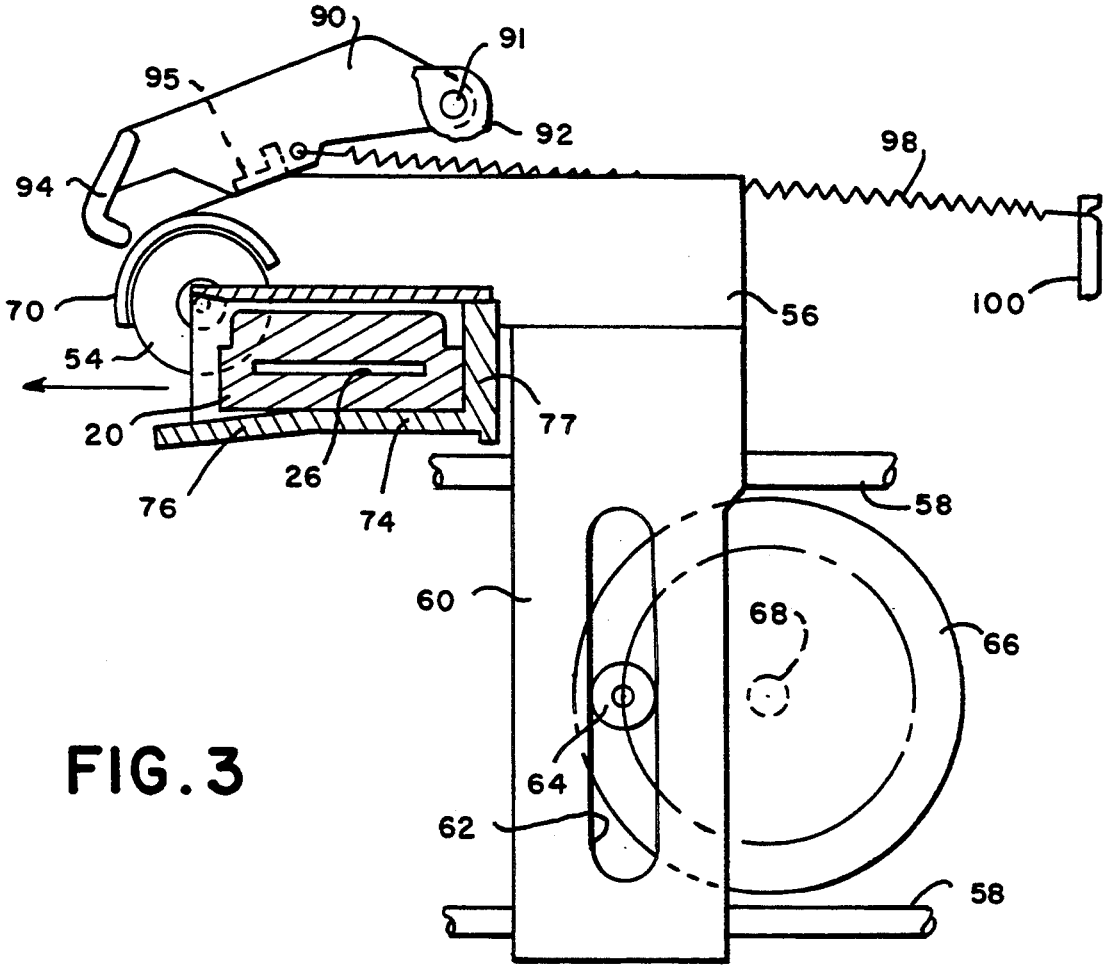
FIG. 3 is an end view of the latching mechanism of the present invention, showing the position of the parts when the mechanism is in its home or static position.

As best seen in FIG. 1, the cutting wheel 54 which is surrounded by a protective hood 70, cooperates with a fixed blade 72 which is mounted on a portion of the mailing machine frame This portion comprises a generally horizontally disposed shelf 74 which projects forwardly in the mailing machine and which has both a slightly downwardly slanting forward portion 76 and a vertically extending rearward portion 77. As best seen in FIG. 3, the shelf 74 supports the free end 52 of the chute 20 when the chute is in its home position, and the vertically oriented portion 77 forms an abutment for the rearward edge of the chute 20 to define the home position of the chute. A tape guide means in the form of a cutter entrance guide plate 78 is mounted on the shelf 74 and includes a horizontally disposed upper guide portion 80 which overlies the path of movement of the tape T and lower vertically oriented guide portion 82 which is contiguous with the fixed blade 72. The upper and lower guide portions 80 and 82 are configured to define a tapered slot 84 which defines an inlet end to a second tape channel 86 leading to the fixed blade 72. Thus, it is now apparent that the lead edge of the tape T must pass from the outlet end 49 of the channel 26, through the slot 84 and into the channel 86 in order for the cutting blades 54 and 72 to be able to sever the tape T.

As is apparent from FIG. 1, the slot 84 and the channel 86 must be substantially as narrow as the channel 26 in the chute 20 in order to maintain the tape T in a flat plane during the cutting operation. If the slot 84 and channel 86 are not this narrow, the tape curls in the channel 86 during the cutting operation and therefore is not be properly cut and jams in the cutting mechanism. By holding the tape virtually flat during the cutting operation, the tape is cut cleanly and evenly with virtually no chance for the tape to jam in the cutting mechanism. However, by maintaining the slot 84 and the channel 86 to almost the same size as the tape, it becomes critical to ensure that at the outlet end 48 of the first tape channel 26 is perfectly aligned with the inlet slot 84 and the second tape channel 86. Any misalignment of these parts causes the lead edge of the tape T to snag on one side or the other of the inlet slot 86, which again results in the tape jamming in the entrance to the cutting mechanism 50.

Figure 4:
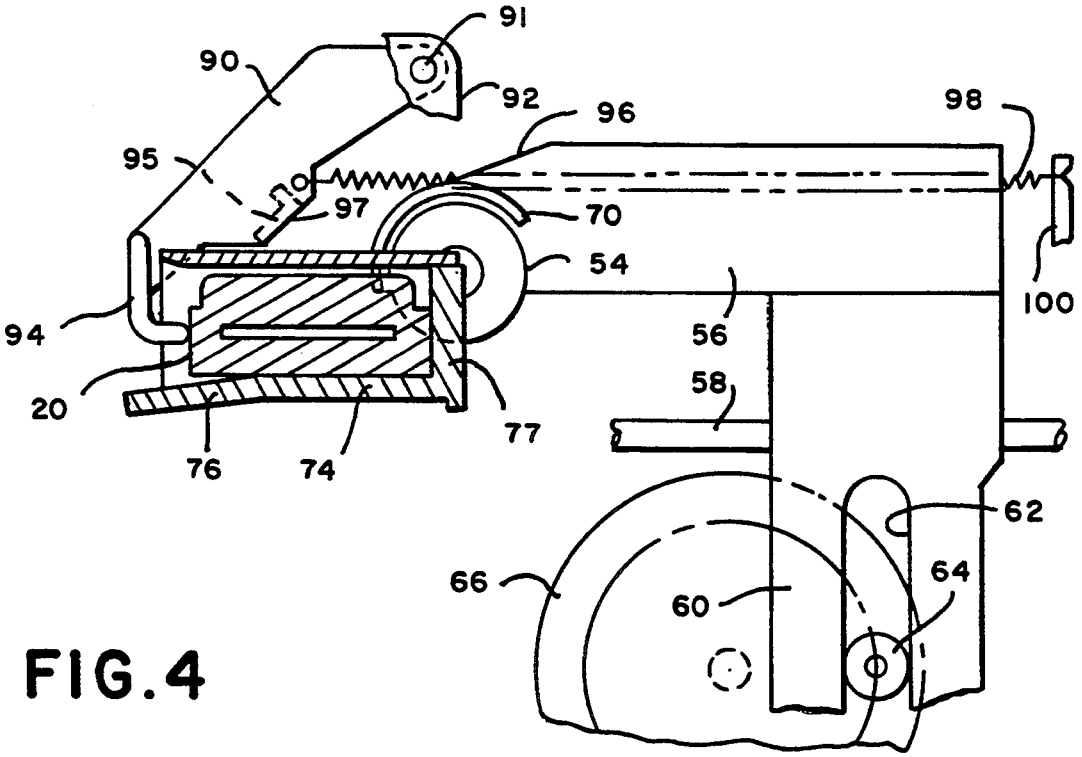
FIG. 4 is a view similar to FIG. 3 showing the position of the parts when the knife is retracted to cutting position and the latch assembly is in its latched position.

To ensure the proper alignment between the outlet end of the channel 26 and the inlet end of the channel 86, a latching mechanism is provided which latches the free end 52 of the chute 20 in a precise location each time the chute is operated to move the tape T from the home position to the printing position. The latching mechanism comprises an elongate latching bar 90 disposed in parallel relationship with the cutter arm 56 and which is pivotally connected at one end by a stub shaft 91 to a portion 92 of the mailing machine frame. The other end of the latching bar terminates in a latching finger 94 which is generally L-shaped and is adapted to press against the forward side wall of the chute 20 when the latching bar 90 is in its latching position, as seen in FIG. 4. The latching bar 90 is provided with a lateral extension 95 (FIG. 1) which has a camming surface 97 on the underside thereof which cooperates with another camming surface 96 formed on the upper side of the cutter arm 56, so that when the cutter am 56 is in its home position as shown in FIG. 3, the camming surfaces 96 and 97 are in engagement to maintain the latching bar 90 in the elevated or unlatching position. A spring 98 is connected between the latching bar 90 and a suitable anchor point 100 on the mailing machine frame so as to urge the latching bar 90 in a counterclockwise direction as viewed in FIG. 3. Thus, as the cutter arm 56 moves from the position shown in FIG. 3 to that shown in FIG. 4, the latching bar 90 is rotated about the pivot shaft 91 to bring the latching finger 94 into contact with the forward wall of the chute 20. The force exerted by the spring 98 is sufficient to cause the latching finger 94 to maintain the end 50 of the chute 20 firmly against the abutment 77.

A complete cycle of operation of the foregoing apparatus will now be described. In the normal or static condition of all the parts, the chute 20 is in the rearward or home position as seen in FIG. 2, the cutting device is in the forward position and the latching mechanism is in the unlatched position, both as seen in FIG. 3, and the lead edge of the tape T is approximately in the position L indicated in FIG. 2. When the mailing machine operator actuates the appropriate control to call for a tape printing operation, the motor 38 is energized to operate the drive assembly 40 to cause the housing 34 to move forwardly along the rails 36, thereby moving the chute 20 from the home position to the printing position in which the tape T is disposed directly beneath the printing die 14 of the postage meter module. The platen 18 then rises in response to the drive mechanism disclosed in the aforementioned Patent No. 4,929,106 until it contacts the lower surface of the lower wall of the chute 20 and continues to rise until it presses the tape T into firm contact with the printing die 14 through the aperture 32 formed in the upper wall 24 of the chute 20. The platen then moves downwardly to its original position, thereby permitting the chute 20 to return to the level shown in FIG. 1, after which the motor 38 and drive assembly 40 return the chute to its home position. At this point, the motor 66 is energized to rotate the eccentric wheel 64 so as to drive the cutter arm 56 rearwardly, thereby moving the cutting wheel to the rear edge of the chute 20 and disengaging the camming surfaces 94 and 96 on the cutter arm 56 and latching bar 90 respectively, thereby allowing the latching bar 90 to pivot counterclockwise about the stub shaft 91 in response to the force of the spring 98, and bring the latching finger 94 into engagement with the forward edge of the chute 20, as shown in FIG. 4. At this point, the free end 52 of the chute 20 is firmly latched against the abutment 77 with the outlet end of the channel 26 precisely aligned with the inlet slot 84 of the cutting mechanism.

At some appropriate time during the preceding movement of the chute 20, the drive assembly 40 becomes effective to connect the feed rollers 42 to the motor 38 so that the feed rollers 42 commence movement of the tape T through the channel 26 in the chute 20. When the lead edge L of the tape passes the outlet end of the channel 26, it will enter the slot 84 in a smooth and unobstructed manner due to the precise alignment of the outlet end of the channel 26 and the inlet slot 84 of the cutting mechanism, and will pass along the feed slot 86 and past the edge of the fixed blade 72. The tape T continues to move in this manner until the entire printed portion thereof has passed the edge of the fixed blade 72, at which time the feed rollers 42 are caused to stop. The motor 66 is then again energized to cause the eccentric roller 64 to move the cutter arm 56 forwardly so that the cutting wheel 54 now moves across the stationary tape in cooperation with the fixed blade and severs the printed portion T' from the rest of the tape strip, from where it can be manually retrieved or fed to a different location for manual retrieval by any suitable feeding means. As the cutting arm moves forwardly, the camming surfaces 96 and 97 reengage to pivot the latching bar 90 clockwise to raise the latching finger 94 back to the position shown in FIG. 3, thereby releasing the chute 20 for forward movement at the beginning of the next cycle of operation. The final step in the cycle of operation is that the feed rollers 42 are now rotated in a reverse direction to pull the tape back through the channel 26 in the chute 20 until the lead edge L thereof returns to the position shown in FIG. 2. The entire apparatus is now conditioned for the next tape printing cycle of operation.

It will be apparent to those skilled in the art that many modifications and alterations can be made to the above described apparatus without departing from the spirit and scope of the invention, the extent of which shall be determined only by the limitations of the claims appended hereto.

What is claimed is

1. A tape positioning apparatus for use in a mailing machine having means for printing a postage indicia on a discrete portion of a strip of tape of indefinite length which is fed intermittently through the mailing machine, said apparatus comprising:

a) a printing device mounted in the mailing machine and defining a printing position, said printing device including means for printing a postage indicia on the strip of tape as it is fed intermittently through the mailing machine, b) an elongate chute having wall means for defining a first tape channel extending through said chute, said first tape channel having inlet and outlet ends through which the strip of tape is adapted to be fed, c) tape guide means disposed adjacent said outlet end of said first tape channel for defining a second tape channel extending therethrough, said second tape channel having an inlet end normally disposed adjacent said outlet end of said first tape channel and an outlet end spaced from said inlet end of said second tape channel, d) tape cutting means disposed adjacent said outlet end of said second tape channel for cutting said tape after a printed portion thereof passes said outlet end of said second tape channel, e) means mounted in the mailing machine for supporting said chute for reciprocatory movement between a home position in which said chute is disposed remote from said printing position an said first and second tape channels are in longitudinal alignment, and said printing position in which the tape therein is in operative relationship with said printing device and said first and second tape channels are disposed out of longitudinal alignment, and f) means mounted adjacent said outlet end of said first tape channel for latching said chute adjacent said outlet end of said first tape channel when said chute is in said home position so that said outlet end of said first tape channel is in precise alignment with said inlet end of said second tape channel, whereby a leading edge of an unsevered strip of tape passes smoothly from said elongate chute to said cutting means after each successive printing operation.

2. A tape positioning apparatus as set forth in claim 1 wherein a) said tape cutting means is mounted for reciprocatory movement across the path of movement of said tape adjacent said outlet end of said second tape channel, and b) said latching means includes means responsive to said reciprocatory movement of said cutting means for latching and unlatching said chute.

3. A tape positioning apparatus as set forth in claim 2 wherein a) said tape cutting means includes an abutment member, and b) said means on said latching means responsive to said reciprocatory movement of said cutting means comprises means mounted in the path of movement of said abutment member for causing said latching means to latch and unlatch said outlet end of said elongate chute as said cutting means moves across said path of movement of said tape.

4. A tape positioning apparatus as set forth in claim 3 wherein said latching means comprises a latching bar mounted for movement between a latching position in which said latching bar latches said elongate chute in said home position and an unlatching position in which said latching bar permits movement of said elongate chute.

5. A tape positioning apparatus as set forth in claim 4 wherein said latching bar is mounted at one end for pivotal movement and has a latching finger at a free end thereof projecting at an angle to the longitudinal axis of said latching bar, said latching finger being adapted to abut a side wall of said elongate chute when said latching bar is in said latching position.

6. A tape positioning apparatus for use in a mailing machine having means for printing a postage indicia on a discrete portion of a strip of tape of indefinite length which is fed intermittently through the mailing machine, said apparatus comprising:

a) a printing device mounted in the mailing machine and defining a printing position, said printing device including means for printing a postage indicia on the strip of tape as it is fed intermittently through the mailing machine, b) an elongate chute having wall means for defining a first tape channel extending through said chute, said first tape channel having inlet and outlet ends through which the strip of tape is adapted to be fed, c) tape guide means disposed adjacent said outlet end of said first tape channel for defining a second tape channel extending therethrough, said second tape channel having an inlet end normally disposed adjacent said outlet end of said first tape channel and an outlet end spaced from said inlet end of said second tape channel, d) tape cutting means disposed adjacent said outlet end of said second tape channel for cutting said tape after a printed portion thereof passes said outlet end of said second tape channel, e) means mounted in the mailing machine for supporting said chute for reciprocatory movement between a home position in which said chute is disposed remote from said printing position an said first and second tape channels are in longitudinal alignment, and said printing position in which the tape therein is in operative relationship with said printing device and said first and second tape channels are disposed out of longitudinal alignment, and f) a latching bar mounted for movement adjacent said outlet end of said first tape channel between a latching position in which said latching bar latches said elongate chute in said home position so that said outlet end of said first type channel is in precise alignment with said inlet end of said second tape channel and an unlatching position in which said latching bar permits movement of said elongate chute, whereby at times when said elongate chute is in said home position a leading edge of an unsevered strip of tape passes smoothly from said elongate chute to said cutting means after a printing operation.

7. A tape positioning apparatus as set forth in claim 6 wherein a) said tape cutting means is mounted for reciprocatory movement across the path of movement of said tape adjacent said outlet end of said second tape channel, and b) said latching means includes means responsive to said reciprocatory movement of said cutting means for latching and unlatching said chute.

8. A tape positioning apparatus as set forth in claim 7 further comprising means for biasing said latch bar toward said home position.

9. A tape positioning apparatus as set forth in claim 7 further comprising a shelf connected to a frame of the mailing machine, said shelf supporting said outlet end of said first tape channel such that said latching bar latches said elongate chute into abutment with said shelf to define said home position.

* * * * *